US005167545A

United States Patent [19]

O'Brien et al.

[11] Patent Number: 5,167,545

[45] Date of Patent: Dec. 1, 1992

[54] CONNECTOR CONTAINING FUSIBLE MATERIAL AND HAVING INTRINSIC TEMPERATURE CONTROL

[75] Inventors: Philip T. O'Brien, Belmont; Douglas Wilkerson, Union City, both of Calif.

[73] Assignees: Metcal, Inc., Menlo Park, Calif.; AMP Incorporated, Middletown, Penn.; a part interest

[21] Appl. No.: 678,801

[22] Filed: Apr. 1, 1991

[51] Int. Cl.[5] ..... H01R 4/02

[52] U.S. Cl. ..... 439/874; 439/578; 439/886

[58] Field of Search ..... 219/10.79, 85.11, 10.75; 439/874, 578, 730, 932, 886; 29/860; 174/84 R, 88 C, DIG. 8

[56] References Cited

U.S. PATENT DOCUMENTS

| | | | |
|---|---|---|---|
| 3,239,125 | 3/1966 | Sherlock . | |
| 3,243,211 | 3/1966 | Wetmore . | |
| 3,305,625 | 2/1967 | Ellis . | |
| 3,316,343 | 4/1967 | Sherlock . | |
| 3,324,230 | 6/1967 | Sherlock . | |
| 3,525,799 | 8/1970 | Ellis . | |
| 3,541,495 | 11/1970 | Ellis et al. . | |
| 4,256,945 | 3/1981 | Carter et al. | 219/10.79 |
| 4,497,533 | 2/1985 | Genova et al. . | |
| 4,852,252 | 8/1989 | Ayer | 174/84 R |
| 4,894,030 | 1/1990 | Chavaroux . | |
| 4,914,267 | 4/1990 | Derbyshire . | |
| 4,991,288 | 2/1991 | Scholz | 29/860 |
| 4,995,838 | 2/1991 | Ayer et al. | 29/860 |
| 5,053,595 | 10/1991 | Derbyshire | 219/10.79 |

FOREIGN PATENT DOCUMENTS

| | | |
|---|---|---|
| 2023944 | 1/1990 | United Kingdom . |
| WO90/03090 | 3/1990 | World Int. Prop. O. . |

*Primary Examiner*—David L. Pirlot

*Attorney, Agent, or Firm*—Burns, Doane, Swecker & Mathis

[57] ABSTRACT

An electrical connector including a member, a heater element comprising a coating of ferromagnetic material on the member and a fusible material. The fusible material is melted when the ferromagnetic material is heated inductively by an alternating magnetic field. The connector can be attached to an end of a coaxial cable. The member can comprise a metal ferrule soldered around a tubular conductor of the coaxial cable and/or a central contact having a bore in one axial end thereof in which a central conductor of the coaxial cable is soldered. A dielectric coating can be provided over the coating of ferromagnetic material on the ferrule and/or central contact. The fusible material can be held in the bore in the central contact or between the dielectric coating and an electrically insulating heat-shrinkable sleeve around the ferrule. The ferrule can include one or more ports therethrough for passage of the fusible material into contact with the tubular conductor. The central contact can include one or more holes for escape of gases when the fusible material melts. To prevent shielding of the ferromagnetic material when the fusible material is located outwardly thereof, the fusible material forms a non-continuous electrically conducting path around the ferromagnetic material.

38 Claims, 1 Drawing Sheet

CONNECTOR CONTAINING FUSIBLE MATERIAL AND HAVING INTRINSIC TEMPERATURE CONTROL

FIELD OF THE INVENTION

The present invention relates to connectors containing fusible materials to assist in forming a connection and more particularly to such connectors which, during the heating of the fusible material, form part of a circuit, the temperature of which is autoregulated at about the Curie temperature of magnetic material included in the circuit during at least the heating operations.

BACKGROUND OF THE INVENTION

U.S. Pat. No. 3,243,211 ("Wetmore") discloses a connector containing a fusible material so that upon insertion of an object to be joined to the connector or upon insertion into the connector of two members to be joined, and upon heating of the connector, the fusible material is caused to melt and to contact the object or objects and to effect a bond upon cooling. The connector may also include a heat-recoverable member whereby the liquified fusible material is bounded and caused to contact the object or objects while in the fluid state. This device requires an external heat source such as hot air or an infrared radiant source in order to melt the fusible material.

A problem with the Wetmore device is that it can cause overheating of objects to be soldered or otherwise bonded as well as adjacent objects. In the electronics art, for instance, overheating of delicate integrated circuits is a problem as is overheating of circuit boards, mastics, resins, heat-shrinkable polymers, glues, potting compounds—all of which can be degraded or destroyed by the application of excessive heat. Further, the Wetmore device has little utility for joining wires, tubes or members which are large effective heat sinks since the large amount of heat required cannot be readily transferred through the heat-shrinkable sleeve without damaging it.

U.S. Pat. No. 4,914,267 ("Derbyshire") relates to connectors containing fusible materials to assist in forming a connection, the connectors forming part of a circuit during the heating of the fusible material In particular, the temperature of the connectors is autoregulated at about the Curie temperature of the magnetic material included in the circuit during the heating operations. The connector may be a ferromagnetic member or may be a part of a circuit including a separate ferromagnetic member.

Derbyshire explains that autoregulation occurs as a result of the change in value of mu (a measure of the ferromagnetic properties of the ferromagnetic member) to approximately 1 when the Curie temperature is approached. In particular, the current spreads into the body of the connector thus lowering the concentration of current in a thin layer of magnetic material, and the skin depth changes by at least the change in the square root of mu. Resistance to current flow reduces, and if the current is held at a constant value, the heating effect is reduced to below the Curie temperature, and the cycle repeats. Thus, the system autoregulates about the Curie temperature.

Derbyshire discloses embodiments wherein the connector is made of ferromagnetic material and a high frequency constant a.c. current is passed through the ferromagnetic material causing the connector to heat until its Curie temperature is reached. When this happens, the effective resistance of the connector reduces and the power dissipation falls. By proper selection of current, frequency and impedance, and proper selection of thickness of materials, the temperature is maintained at about the Curie temperature of the magnetic material of the connector.

In another embodiment of Derbyshire, the connector is made of a highly conductive, nonmagnetic material, and a crimping tool having ferromagnetic jaws is used to heat the connector by supplying a high frequency, constant current to opposite ends of the jaws. In a further embodiment, a laminar ferromagnetic-non-magnetic heater construction comprises a copper wire, tube, rod or other metallic element in a ferromagnetic sleeve. In this case, current at proper frequency applied to opposite ends of the sleeves flows through the sleeve due to the skin effect until the Curie temperature is reached, at which time the current flows primarily through the copper wire. In a still further embodiment of Derbyshire, the connector includes a copper sleeve with axially-spaced rings of high mu materials of different Curie temperatures so as to produce different temperatures displaced in time and space.

SUMMARY OF THE INVENTION

The present invention provides an electrical connector which includes a member, heater element means and a fusible material. The heater element means comprises a ferromagnetic material on the member for heating the member to an autoregulated temperature. The ferromagnetic material has a Curie temperature at least equal to the autoregulated temperature, and the ferromagnetic material can be heated inductively to the Curie temperature when an alternating magnetic field is applied thereto.

The fusible material is disposed on the member so as to be in heat-conducting relationship therewith and the fusible material has a melting temperature no greater than the autoregulated temperature. According to one aspect of the invention, the fusible material extends at least part way around the ferromagnetic material such that the fusible material forms a noncontinuous electrically conducting path around the ferromagnetic material. According to another aspect of the invention, the fusible material is provided in a bore in the member.

According to one embodiment, the member can comprise an electrically conducting metal ferrule. The fusible material can partially surround the ferrule such that a gap separates opposed ends of the fusible material. The gap is wide enough to prevent surface voltages on the fusible material from arcing between the opposed ends when the ferromagnetic material is heated by electrical currents and eddy currents generated therein by an alternating magnetic field. The fusible material can comprise a gapped solder ring, in which case the gap can extend in a direction parallel to a central axis of the ferrule.

The member can comprise a unitary body of the ferromagnetic material, in which case the heater element means comprises an outer layer of the body. In the case where the member comprises an electrically conducting metal ferrule, the ferromagnetic material can comprise a coating on an outer periphery of the ferrule. The coating of ferromagnetic material can extend completely around the ferrule, and the ferromagnetic material can have a length in the axial direction equal to or less than the length of the ferrule.

A dielectric coating can be provided on an outer periphery of the ferromagnetic material and/or the ferrule. The fusible material can be disposed on an outer periphery of the dielectric coating. In the case where the ferromagnetic material comprises a coating, the thickness of the coating can be less than about 1/20 of the thickness of the ferrule.

The connector can include an electrically insulating heat-shrinkable sleeve surrounding the ferrule. The fusible material can be disposed between the outer periphery of the dielectric coating and an inner periphery of the sleeve.

The connector can be attached to a free end of a coaxial cable. The coaxial cable includes an inner central conductor, an outer tubular conductor and a dielectric material therebetween. The tubular conductor can have an outer periphery thereof facing an inner periphery of the ferrule. The ferrule can include at least one port means therethrough for passage of the fusible material into contact with the tubular conductor. As such, the tubular conductor can be joined to the ferrule when the ferromagnetic material is heated to cause melting of the fusible material and shrinkage of the sleeve.

The connector can include a hollow metal body and a metal tightening nut, the body rotatably supporting the nut, and the body being in electrical contact with the tubular conductor. The conductor can include a hollow metal extension which has at least one tapered surface, and the body can include at least one flange, the flange fitting around the tapered surface so as to clamp a front end of the extension to a rear end of the body. The outer periphery of the extension can face an inner periphery of the tubular conductor. The sleeve can surround a portion of the body, the fusible material and a portion of the ferrule.

According to another embodiment, the member comprises part of an electrically conducting metal pin which is U-shaped in lateral cross-section. The fusible material is disposed on a concave surface of the pin, a sleeve of heat-recoverable electrically insulating material surrounds the pin, and the ferromagnetic material is disposed on a convex surface of the pin. The Curie temperature of the ferromagnetic material is at least equal to a recovery temperature at which the sleeve shrinks when heat is applied thereto.

The member can comprise a metal selected from the group consisting of copper and aluminum. The ferromagnetic material can comprise a Ni-Fe alloy. The dielectric coating can comprise polyimide.

The invention also provides a method of effecting an electrical connection between a conductor and an electrical connector. The electrical connector includes a member, heater element means and a fusible material. The heater element means comprises a ferromagnetic material disposed on the member for heating the member to an autoregulated temperature. The ferromagnetic material has a Curie temperature at least equal to the autoregulated temperature, and the ferromagnetic material can be heated inductively to the Curie temperature when an alternating magnetic field is applied thereto. The fusible material is disposed on the member so as to be in heat-conducting relationship therewith. The fusible material extends at least part way around the ferromagnetic material such that the fusible material forms a non-continuous electrically conducting path around the ferromagnetic material. The fusible material is melted when an alternating magnetic field is applied to the ferromagnetic material.

In the case in which the member comprises an electrically conducting metal ferrule wherein the fusible material surrounds the ferrule and the conductor comprises a tubular conductor of a coaxial cable, the method can further comprise a step of inserting an outer periphery of the tubular conductor within the ferrule. In the case in which the connector includes a dielectric coating disposed on the ferrule and an electrically insulating heat-shrinkable sleeve surrounding the ferrule with the fusible material between the outer periphery of the dielectric coating and an inner periphery of the sleeve, the method can further comprise heating the sleeve during the heating step such that the sleeve shrinks and squeezes the molten fusible material between the ferrule and the tubular conductor. In the case in which the ferrule includes at least one port means therethrough for passage of the fusible material into contact with the tubular conductor, the method can further comprise flowing molten fusible material through the port means during the heating step. In the case in which the connector includes a hollow metal body, the method can further comprise a step of placing one end of the sleeve over an outer periphery of the body prior to the heating step. In the case in which the connector includes a hollow metal extension, the method can further comprise a step of placing an outer periphery of the extension within an inner periphery of the tubular conductor.

The method is also applicable to a connector wherein the member comprises part of an electrically conducting metal pin which is U-shaped in lateral cross-section. In this case, the fusible material can be disposed on a concave surface of the pin, the ferromagnetic material can be disposed on a convex surface of the pin, and a sleeve of heat-recoverable electrically insulating material having a recovery temperature can surround the pin and the fusible material. The ferromagnetic material should have a Curie temperature equal to a temperature no lower than the recovery temperature, and the method can include shrinking the sleeve by heating the sleeve to its recovery temperature during the heating step.

According to a further embodiment, the electrical connector comprises a member, heater element means and a fusible material. The heater element means comprises a ferromagnetic material on an outer periphery of the member for heating the member to an autoregulated temperature. The ferromagnetic material has a Curie temperature at least equal to the autoregulated temperature and the ferromagnetic material is heated inductively to the Curie temperature when an alternating magnetic field is applied thereto. The fusible material is disposed in a bore in the member so as to be in heat conducting relationship therewith. The fusible material has a melting temperature no greater than the autoregulated temperature and the fusible material is melted when an alternating magnetic field is applied to the ferromagnetic material and the member is heated to the autoregulated temperature.

The member can comprise a central contact of the connector. The bore can extend in an axial direction into one axial end of the central contact. The fusible material can fill part of the bore. A radially extending hole can extend between the bore and an outer periphery of the central contact. The ferromagnetic material can comprise a coating on an outer periphery of the central contact. The coating of ferromagnetic material can extend completely around the central contact and can have a length in the axial direction at least equal to a length in the axial direction of the bore. A dielectric coating can be provided on an outer periphery of the ferromagnetic material and/or the central contact. The ferromagnetic material can have a thickness in a radial direction less than about 1/20 of the thickness in the radial direction between an inner surface of the central contact defining the bore and the outer periphery of the central contact. A free end of a coaxial cable can be attached to the connector. The coaxial cable can include an inner central conductor and an outer tubular conductor insulated from the central conductor by a dielectric material. An end of the central conductor can be located in the bore and the fusible material can bond the central conductor to the central contact.

BRIEF DESCRIPTION OF THE DRAWING

The invention will now be described with reference to the accompanying drawing, in which.

DETAILED DESCRIPTION OF THE PREFERRED EMBODIMENTS

Figure 1:
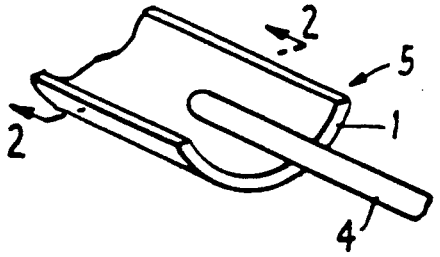
FIG. 1 shows a perspective view of an electrical connector in accordance with a first embodiment of the invention.

The present invention relates to connectors containing fusible materials to assist in forming a soldered mechanical connection and more particularly to such connectors which, during the heating of the fusible material, form part of an induction heating circuit, the temperature of which is autoregulated at about the Curie temperature of the magnetic material included in the induction heating circuit at least during the heating operations.

One aspect of the invention provides an extremely energy efficient and rapid acting autoregulating heater/connector which contains a "gapped" fusible material (i.e., the fusible material does not form a continuous electrically conductive path around the fusible material). By introducing this "gap" into the fusible material, the induced current flow path is eliminated. Without a gap, induced current within the fusible material would produce a magnetic "bucking" field which would cancel much of the . induction coil's magnetic field current producing effect upon the autoregulating ferromagnetic material. By "gapping" the fusible material, the autoregulating ferromagnetic material is effectively unshrouded and made available for heating.

The autoregulating heater can be maintained during the melting of the fusible material at a temperature not appreciably above the melting temperature of the fusible material. The connector is heated by an induced alternating magnetic field which causes the fusible material to melt and the elements to be connected.

The present invention makes use of the skin effect produced in ferromagnetic bodies when an alternating current is applied thereto. When such a current is applied to a ferromagnetic body, a major proportion of the current is concentrated in a region adjacent the ground return path of the current. This region is defined by the equation:

$$S.D. = 5030 \sqrt{\frac{\rho}{\mu f}} \text{ cm}$$

where S.D. is skin depth, $\rho$ is resistivity, $\mu$ (mu) is a measure of the ferromagnetic properties of the material, and f is the frequency of the alternating current source. The skin depth may be controlled by controlling $\rho$, $\mu$, and f. Alloy 42 has $$\rho = 70\text{–}80 \times 10^{-6} \text{ ohm cms and } \mu = 200\text{–}600$$

while low carbon steel has $$\rho = 10 \times 10^{-6} \text{ ohm cms and } \mu = 1000.$$

The frequency may be chosen to suit the needs of the connector. It should be noted that 83% of the current is concentrated in 1.8 times the skin depth, based upon the fact that current falls off in accordance with $e^{-x}$ where x is the depth into the ferromagnetic layer. The heating effect of the current flowing through the ferromagnetic material is employed in the present invention to heat a connector.

Autoregulation occurs as a result of the change in the value of $\mu$ to approximately 1 when the Curie temperature is approached. Consequently, the current spreads into the body of the connector, thus lowering the concentration of current in the thin layer of magnetic material. The skin depth is changed by at least the change in the square root of $\mu$; in Alloy 42, a change of $\sqrt{200}$ to $\sqrt{600}$, and in low carbon steel, a change of $\sqrt{1000}$. Resistance to current flow reduces, and if the current is held at a constant value, the heating effect is reduced to below the Curie temperature, and the cycle repeats. Thus, the system autoregulates about the Curie temperature. The performance of the aforesaid circuit is acceptable for some purposes, but the autoregulation is not rigid, and large variations in temperature are produced in the presence of large thermal loads since the change in resistance is not great and results from a reduction of current concentrations only.

As mentioned in U.S. Pat. No. 4,256,945 ("Carter") and the Derbyshire patent, excellent regulation can be achieved when the ferromagnetic layer is 1.8 skin depths thick and is in electrical and thermal contact with a layer of high conductivity material having a $\mu$of 1, such as copper. When the Curie temperature of the ferromagnetic material is approached, $\mu$ goes to 1 and $\rho$ approaches the resistivity of copper, $2 \times 10^{-6}$ ohms cms. Thus, if the ferromagnetic material is low carbon steel, $\mu$ falls from 1000 to 1 and $\rho$falls from $10 \times 10^{-6}$ to $2 \times 10^{-6}$ ohm cms. If Alloy 42 is employed, $\mu$ falls from between 200 and 600 to 1, and $\rho$ falls from $70\text{–}80 \times 10^{-6}$ ohm cms to close to $2 \times 10^{-6}$ ohm cms. Thus, the change in heating effect is marked, being about 3:1 in the case of the ferromagnetic material alone, and being as high as 160:1.

In order to prevent damaging levels of magnetic flux or skin currents from being produced, the thickness of the copper layer should be 5 to 10 times the skin depth in the copper when the heater is above the Curie temperature. The induction coil used to heat the ferromagnetic material can be operated at frequencies of 8 to 20 MHz to reduce the thickness of the layer of magnetic material required, but primarily to produce very large autoregulating ratios. Also, the copper layer can be replaced by a second ferromagnetic layer of high Curie point and preferably lower resistivity. Thus, when the Curie temperature of the lower Curie temperature material is reached, the current spreads into the lower resistivity ferromagnetic material where it is confined to a thin layer of the latter material. In such an arrangement, low frequencies, for instance 50 Hz, may be employed with autoregulating ratios of 4:1. In addition, a thin copper layer can be disposed between two ferromagnetic layers. Upon reaching the Curie temperature of the lower temperature ferromagnetic material, the current spreads primarily into the copper and is confined in the second ferromagnetic layer by skin effects of a material having a $\mu$ of 1000, for instance. With little current in this second layer combined with a strong skin effect, quite thin devices producing little radiation may be fabricated while operating at low frequencies. Autoregulating ratios of 30:1 are achieved at about 8000 Hz.

To heat the connector of the invention, a high frequency constant a.c. current is passed through the ferromagnetic material causing the connector to heat until its Curie temperature is reached. At such time, the effective resistance of the connector reduces and the power dissipation falls so that by proper selection of current, frequency and impedance, and proper selection of thickness of materials, the temperature is maintained at about the Curie temperature of the magnetic material of the connector.

The fusible material may be any number of meltable materials such as solders for electrical, mechanical or plumbing applications or brazing materials. The fusible material is incorporated in or located adjacent the connector, and upon heating, flows around or within a member or members to be bonded to the connector, to each other, or to both. To produce the flow, a heat-shrinkable material can be used. Capillary action and suitably located holes may also be employed in appropriate circumstances, as well as the wetting action of the molten material on certain other materials which may form the connector or the objects to be connected.

Several fusible materials may be incorporated in the same connector, and a suitable flux can be incorporated in the fusible material. A fusible material such as a polymer or resin can be used to seal or environmentally protect the connector. The same or another fusible material may be used to contain or direct the flow of solders. A heat-shrinkable material activated by the heating action of the connector can shrink to enclose the connector area. Likewise, a heat-shrinkable material may also be used as a dam, after shrinking, to confine the molten fusible material to appropriate regions.

The fusible material is adapted to be incorporated in an electric circuit as a part thereof. The circuit is completed when the connector is heated and the fusible material becomes molten and flows to effect a mechanical bond between the connector and one or more conductors.

The connector acts as an autoregulating heater so that heat does not have to be transferred through surrounding layers of plastics, insulations, etc., and as a result, uniform heating of large as well as small objects to exact temperatures may be achieved at a rapid rate relative to the size of the objects to be joined.

The connector provides autoregulated heat to melt a fusible material by means of an inductive current source. That is, a.c. current in a primary induction coil induces current and thereby $I^2R$ heat in the connector and fusible material. The connector serves as a secondary inductor which is preferably tightly coupled to the primary induction coil, e.g., with substantially one-to-one coupling. With an inductive source, autoregulated heating to melt a fusible material can be effected in environments wherein a connector and fusible material are not accessible to a power source connected directly thereto. Hence, many geometries and uses of the connector according to the invention can be realized. Due to the autoregulating effect of the heater circuit, no more energy than is required to achieve the junction is expended, and since the entire sleeve can be the heater, cold spots which impair the integrity of the junction do not develop.

Upon energization of an alternating current source, current flows primarily along the inner surface of a lamina of ferromagnetic material provided over a layer of another metal, such as copper, with approximately 63.2% flowing in a skin depth. At 10 MHz, with a material having a $\mu$ of 1000 and a resistivity of $10\times10^{-6}$ ohm cms, the skin depth is approximately 0.0001 inch. For maximum efficiency of the heating, i.e., autoregulating ratio, it is found that the lamina should e approximately 1.5 to 1.8 times skin depth, and thus a quite thin film of high $\mu$ material is all that is required on the copper.

Figure 2:
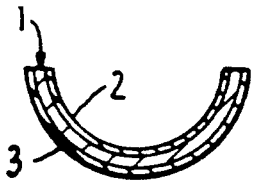
FIG. 2 shows a cross section of the connector shown in FIG. 1 taken along the line 2—2.

FIGS. 1 and 2 show an electrical connector in accordance with a first embodiment of the invention. In particular, member 1 includes a layer of fusible material 2 on one side thereof and a layer of ferromagnetic material 3 on another side thereof, as shown in FIG. 2. In this embodiment, member 1 can be a pin or an array of pins, each of which includes a spoon-type back end which is bonded to conductor 4 to form electrical connector 5, as shown in FIG. 1.

Thus, in this embodiment, fusible material 2 is provided on a concave surface of member 1, and ferromagnetic material 3 is provided on a convex surface of member 1. Of course, member 1 can be any desired shape. For instance, member 1 could have a uniform thickness and a flat or non-flat shape. Alternatively, member 1 could be non-uniform in thickness and have a relatively flat or non-flat shape. In addition, member 1 can be a hollow member which is circular, oblong, polygonal, etc. in cross-section.

Although not shown, connector 5 can include a heat-shrinkable sleeve for encapsulating member 1 and conductor 4 when they are bonded together. The bonding is achieved by placing member 1 in contact or close proximity to fusible material 2 (which can be solder) and by applying an alternating magnetic field to ferromagnetic material 3. This causes ferromagnetic material 3 to heat member 1 and to melt fusible material 2 such that it effects a bond between conductor 4 and member 1. The alternating magnetic field can be provided by energizing an induction coil placed around member 1 and conductor 4.

Fusible material 2 can be provided by pretinning one side of member 1. Fusible material 2 should not completely surround ferromagnetic material 3 and should not form a continuous electrically conducting path since electrical currents and eddy currents on the inner and outer surfaces of the fusible material would then create a "shielding effect" on ferromagnetic material 3. This will result in less heat being produced by the ferromagnetic material, thus increasing the time to effect a connection and necessitating greater power requirements. In addition, any dielectric materials exposed to extended heating by ferromagnetic material 3 could be adversely affected with respect to shape and dielectric values of such dielectric materials. According to the invention, the shielding effect is avoided by providing a fusible material which forms a non-continuous electrically conducting path around member 1 and ferromagnetic material 3.

Ferromagnetic material 3 can be any material which heats fusible material 2 to an autoregulated temperature at which fusible material 2 melts when an alternating magnetic field is applied to ferromagnetic material 3. Ferromagnetic material 3 should have its Curie temperature at least equal to the autoregulated temperature. Thus, when ferromagnetic material 3 is inductively heated to its Curie temperature, member 1 and fusible material 2 will be heated to the autoregulated temperature so as to melt fusible material 2. If desired, a plurality of ferromagnetic materials having different Curie temperatures can be used as ferromagnetic material 3. Also, member 1 and ferromagnetic material 3 can comprise a unitary body of ferromagnetic material.

In the case in which ferromagnetic material 3 is provided as a coating on copper member 1, ferromagnetic material 3 can cover all or only part of member 1. That is, ferromagnetic material 3 can cover the entire outer periphery of member 1. However, by providing fusible material 2 in a non-continuous electrically conducting path around ferromagnetic material 3, the non-shielded ferromagnetic material 3 can be reduced in size since it experiences a faster rise in temperature when inductively heated compared to when the ferromagnetic material is shielded. Thus, the size (surface area) of the ferromagnetic material can be selected depending upon the heating requirements and location of the electrical connection to be made. This will depend upon factors well known to those skilled in the art. These factors include whether an electrically insulating heat-shrink sleeve is to be heated, the amount of fusible material to be melted, the distance of the fusible material from the ferromagnetic material, the thermal conductivity of materials between the fusible material and the ferromagnetic material, the presence of heat sinks, etc. The size of ferromagnetic material 3, however, surprisingly and unexpectedly can be smaller in the case in which fusible material 2 is not continuous around ferromagnetic material 3 compared to when the fusible material extends completely around ferromagnetic material 3.

Figure 3:
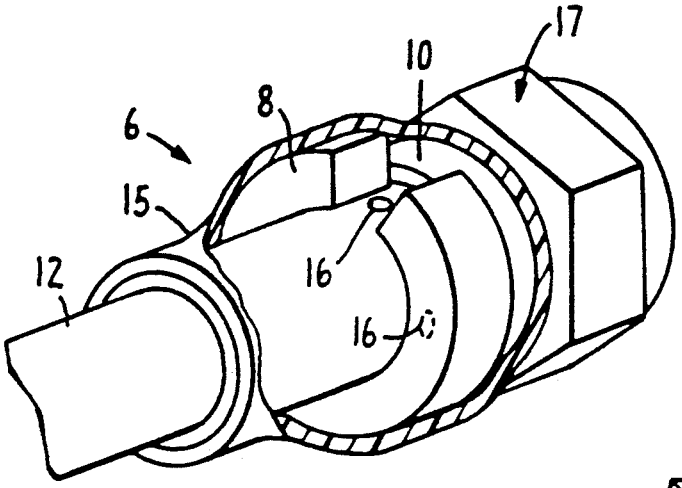
FIG. 3 shows a perspective view of an electrical connector in accordance with a second embodiment of the invention.

FIG. 3 shows electrical connector 6 in accordance with a second embodiment of the invention. Connector 6 is particularly useful for attachment to an end of a flexible or semi-rigid coaxial cable. In this case, the member is in the form of a tube or ferrule 7 of metal such as copper, phosphorus bronze, beryllium copper, aluminum or other suitable material. The fusible material is in the form of "gapped" ring 8 provided around tube 7. The ferromagnetic material is in the form of a coating or cladding 9 on the outer periphery of tube 7.

Fusible material can be provided in other non-continuous forms such as blocks, squares, segments, strips, a helix, etc. provided there is no circumferential joining, overlapping or butting of the fusible material. In other words, if fusible material extends almost or completely around ferrule 7, enough space should be provided between opposed surfaces of fusible material to prevent surface voltages from arcing between the opposed surfaces when ferromagnetic material 3 is heated by electrical and eddy currents generated therein by an alternating magnetic field As explained earlier, all metallic objects within the induced magnetic field will have electrical currents and eddy currents produced primarily on the surfaces thereof. These currents would create a shielding effect if they form a continuous path around ferromagnetic material 3. Accordingly, any metal materials located around ferromagnetic material 3 should form a non-continuous electrically conducting path around the ferromagnetic material.

To prevent the shielding effect, any layer of metal between the induction coil and the ferromagnetic material should not form a continuous electrically conducting path separating the ferromagnetic material from the induction coil. For instance, ferromagnetic material 3 could be located within ferrule 7. In this case, ferrule 7 would provide a shielding effect similar to a continuous ring of solder when the induction coil encircles ferrule 7. As such, to avoid the shielding effect when ferromagnetic material 3 is within ferrule 7, ferrule 7 should not form a continuous electrically conducting path around ferromagnetic material 3. Accordingly, ferrule 7 could be split along the length thereof to a sufficient extent to prevent surface voltages from arcing between opposed surfaces of ferrule 7. As such, if any metallic materials are located radially outwardly of ferromagnetic material 3 and an induction coil is located radially outwardly of such metallic materials, such metallic materials should form non-continuous electrically conducting paths around ferromagnetic material 3 in order to avoid the shielding effect. The induction coil, however, could be placed inside the connector or made part of the ferrule In this case, any metal layers between the induction coil and the ferromagnetic material should be "gapped" to avoid the shielding effect.

Ferromagnetic material 3 acts as a heater element when subjected to an induced alternating magnetic field. As explained earlier, in the induced alternating magnetic field, the flow of induced current generates $I^2R$ losses and heat in the ferromagnetic material due to eddy currents and hysteresis losses. This heating is most intense at the surface thus creating what is called the "skin effect."

When ferromagnetic material 3 is heated to its Curie temperature, the resistance to current flow drops, thus reducing the heat generated. If ferromagnetic material 3 is supported on a base metal (e.g., ferrule 7) such as copper, the current spreads into the body of the base metal when ferromagnetic material is heated to its Curie temperature and above. As a result, the ferromagnetic material acts as a self-regulating heater which provides uniform heating at a substantially isothermal temperature. However, ferrule 7 could be formed entirely of the ferromagnetic material, and the same effects will still be achieved although with much less of a switching ratio between peak power and regulated power.

The materials used for the ferromagnetic material are selected on the basis of the desired Curie temperature that is compatible with the joining process. For instance, the ferromagnetic material can comprise a Ni-Fe alloy such as Alloy 42, Alloy 45 or Alloy 36. The ferromagnetic material can comprise a coating applied by hot dipping, electroplating, sputtering, cladding or any other suitable technique. Also, the ferromagnetic material could be applied as a paste or as one or more discrete pieces attached by metallurgical, adhesive, mechanical or other suitable means to a substrate. Alternatively, member 1 or ferrule 7 could comprise a unitary body of the ferromagnetic material.

The fusible material shown in FIG. 3 comprises gapped ring 8 of solder having a gap 10 separating opposed ends of ring 8. Gap 10 is wide enough to prevent surface voltages on ring 8 from arcing between the opposed ends when ferromagnetic material 9 is heated by an induced alternating magnetic field. Alternatively, gap 10 could extend in a helical direction, i.e., the gap 10 could be provided between opposing sides of a helically-shaped piece of fusible material. As shown in FIG. 3, however, gap 10 extends only in a direction parallel to the central axis of ferrule 7.

In the embodiment shown in FIG. 3, dielectric coating 11 is provided between ferromagnetic material 9 and fusible material of gapped ring 8. Dielectric coating 11 can comprise a thin, high-temperature polyimide insulation layer. Of course, any suitable dielectric material can be used for dielectric coating 11. Dielectric coating 11 is useful in providing a non-wetting surface on ferrule 7 thereby preventing fusible material from coming into direct contact with ferromagnetic layer 9.

Figure 5:
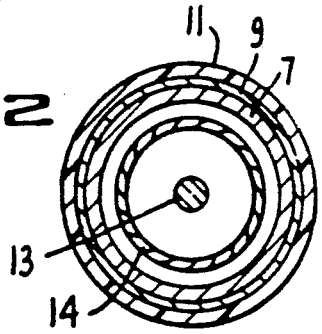
FIG. 5 shows a transverse cross section of the connector shown in FIG. 3 taken along the line 5—5.
Figure 4:
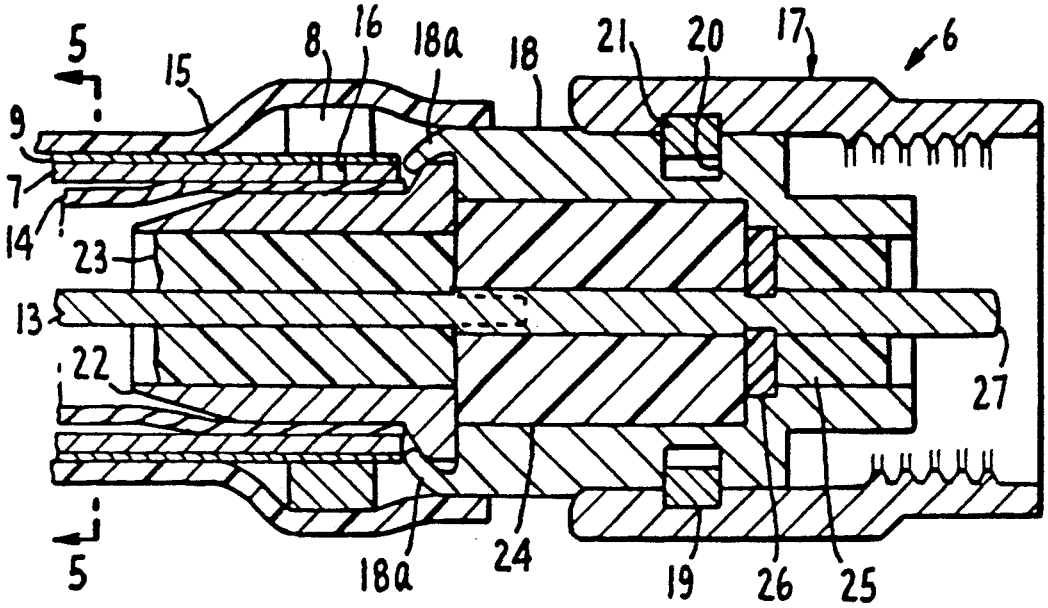
FIG. 4 shows a longitudinal cross-section of the connector shown in FIG. 3.

Connector 6 shown in FIG. 3 can be attached on the end of coaxial cable 12. Cable 12 can be a conventional flexible or semi-rigid cable including central conductor 13 and tubular conductor 14, as shown in FIGS. 4 and 5. A dielectric material separates central conductor 13 from tubular conductor 14.

In the case of the flexible coaxial cable, tubular conductor 14 comprises a metal braid, a copper or silver foil can be provided around the braid, and the outside of the cable comprises an outer layer of plastic. In the case of a semi-rigid coaxial cable, tubular conductor 14 comprises a bare copper tube or a tin-plated copper tube. The tin-plating provides wetting of the surface of the copper tube. The semi-rigid coaxial cable is superior to the flexible coaxial cable in that it can carry signals up to about 40 Gigahertz on the outer surface of the central conductor and on the inner surface of the tubular conductor. The flexible coaxial cable typically can carry signals of up to only about 12 Gigahertz.

It is desirable to provide an electrically insulating heat-recoverable sleeve 15 around fusible material in gapped ring 8. In addition, one or more ports 16 can be provided in the composite formed by dielectric coating 11, the ferromagnetic material and ferrule 7. If dielectric coating 11 is omitted or if the ferromagnetic material is not provided entirely over ferrule 7, each port 16 may extend radially between inner and outer peripheries of ferrule 7 Each port 16 can be located directly beneath fusible material or at a location spaced from fusible material only if a path is provided for flowing fusible material inside ferrule 7. Each port 16 can be intermediate ends of the ferrule or can comprise a notch at the forward end of ferrule 7.

As shown in FIG. 4, the outer periphery of tubular conductor 14 can be in contact with inside of ferrule 7. Alternatively, the outer periphery of tubular conductor 14 can be spaced inwardly from the inner periphery of ferrule 7 in which case the fusible material is used to effect a mechanical connection between tubular conductor 14, ferrule 7 and connector member 22. The object of the connection, however, is to place tubular conductor 14 in electrical contact with the inside surface of connector members 22 and 18.

As shown in FIG. 4, tightening nut 17 is rotatably supported on connector 6 and includes internal threads at a front end of the connector for mating with an externally threaded electrical connector (not shown). Nut 17 can comprise any suitable material such as stainless steel. In particular, nut 17 is rotatably supported around connection member 18 which comprises a circular electrically conducting hollow body by means of annular recess 19 on an inner periphery of nut 17, an annular recess 20 in an outer periphery of body 18 and a ring 21 received in the recesses 19, 20. Body 18 and ring 21 can be any suitable electrically conducting material such as phosphor bronze. Signals carried by tubular conductor 14 pass along the inner periphery of body 18 and then to a mating connector (not shown).

The back end of body 18 includes one or more flanges **18*a* which fit around tapered surfaces of connector member 22 which comprises a hollow cylindrical extension 22 so as to clamp a front end of the extension to a rear end of body 18. Extension 22 can be any suitable electrically conducting material such as stainless steel, but a more wettable material such as phosphor bronze would facilitate a solder connection between the outer surface of extension 22 and the inner surface of ferrule 7 with tubular conductor 14**.

Connector 6 includes dielectric materials, such as Teflon® 23, 24, 25 and 26 therein. In particular, dielectric material 23 comprises a stripped end of the coaxial cable, that is, the dielectric material between central conductor 13 and tubular conductor 14 of coaxial cable 12. Dielectric material 24 is provided in a rear portion of body 18, dielectric material 25 is provided at a front portion of body 18, and dielectric material 26 comprises a thin wafer between dielectric materials 24 and 25. Wafer 26 has a smaller diameter than dielectric materials 24 and 25, and wafer 26 fits in an annular groove in central contact 27 to hold the contact in place. Contact 27 can be soldered or otherwise attached to central conductor 13 prior to attaching ferrule 7.

Figure 6:
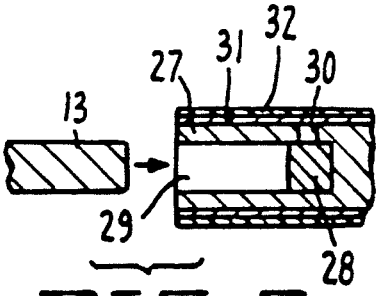
FIG. 6 shows how two parts of the electrical connector shown in FIG. 4 can be joined together.

To attach central contact 27 to central conductor 13, the following operations can be performed. As shown in FIG. 6, central contact 27 can include solder paste 28 in bore 29 and vent means comprising at least one hole 30 for allowing gases to escape during the soldering operation To melt solder 28, central contact 27 can be self heating For instance, central contact 27 can include layer 31 of ferromagnetic material and layer 32 of dielectric material. Layer 31 acts as a heater element in the same manner as ferromagnetic material 9 on ferrule 7. As an example, central contact 27 can include layer 31 of Alloy 42 on the outer periphery thereof in the area surrounding bore 29 and layer 31 can be covered with layer 32 of polyimide Layer 31 can extend a length in the axial direction at least equal to a length in the axial direction of bore 29. Layer 31 can have a thickness in a radial direction less than 1/20 of a thickness in the radial direction between an inner surface of central contact 27 defining bore 29 and the outer periphery of central contact 27. Bore 29 can have a diameter slightly larger than the diameter of the central conductor 13 so as to provide a snug fit therebetween. To melt solder 28, central conductor 13 and central contact 27 can be placed in a suitable induction tool and when an alternating magnetic field is applied to ferromagnetic material 31, solder 28 melts and flows between the outer periphery of central conductor 13 and the inner periphery of central contact 27 defining bore 29.

To attach coaxial cable 12 to connector 6, the following operations can be performed. First, the end of the coaxial cable is stripped to expose central conductor 13 over a length, such as ⅛ inch, dielectric material 23 is exposed over a length, such as 1/16 inch, and tubular conductor 14 is exposed over a length, such as ¼ inch. After central conductor 13 is attached to central contact 27, the outer periphery of extension 22 is inserted under tubular conductor 14 and the inner periphery of extension 22 is fitted over dielectric material 23. If desired, extension 22 can be tapered or can have a larger diameter than the inner diameter of tubular conductor 14. This will cause tubular conductor 14 to be expanded somewhat in fitting it over extension 22. Ferrule 7 is then slid over coaxial cable 12 until the front end of ferrule 7 abuts or is in close proximity to flanges 18*a*. If desired, ferrule 7 may have a diameter slightly smaller than the outer diameter of tubular conductor 14. In this case, ferrule 7 would be expanded to provide a tight mechanical connection between extension 22, tubular conductor 14 and ferrule 7. However, these parts can also be assembled such that they are loosely held together. When ferrule 7 is slid over the part of tubular conductor 14 located around extension 22, sleeve 15 and fusible material 8 can be carried with ferrule 7. Alternatively, sleeve 15 and fusible material 8 can be slid over ferrule 7 after ferrule 7 is slid into contact with flanges 18*a*. In either case, the front end of sleeve 15 is slid over body 18 sufficiently to prevent fusible material 8 from flowing outwardly of sleeve 15.

To melt fusible material 8, an induction coil can be located around connector 6. Then, the induction coil is energized to create an RF electromagnetic field which induces electrical currents and eddy currents on the surfaces of fusible material 8, ferromagnetic material 9, tubular conductor 14 and extension 22. However, due to the unique heating ability of ferromagnetic material 9 and the absence of any continuous ring of metal around ferromagnetic material 9, fusible material 8 is rapidly heated to its melting temperature and flows between the mating surfaces of body 18, extension 22, central conductor 14 and ferrule 7 while heat-recoverable sleeve 15 recovers and squeezes the molten solder between the mating surfaces. Since sleeve 15 and outer dielectric coating 11 are non-wetting, fusible material 8 will not spread to any great extent between sleeve 15 and dielectric coating 11.

The "gapped" solder preform of the invention allows much faster heater ferrule heat-up, essentially before complete melting of the solder. As such, the heat-up rate is not affected even if the solder melts and forms a continuous electrically conducting path around ferromagnetic material 9. A joint connection using a continuous ring of solder may take 5 seconds or longer. With a gapped (i.e., discontinuous) ring of solder, the connection can be made almost twice as fast. For example, with the connector of the invention, gapped ring 8 can be melted and heat-recoverable sleeve 15 can be shrunk in about 3 seconds.

In addition to the advantages described above, the connector of the invention can be inductively heated with the same induction coil despite changes in the diameters of the connectors. For connectors having a continuous ring of solder, it has been necessary to use a different induction coil/matching network tooling configuration for each size connector. The connector of the invention can have different sizes and shapes and still be readily terminated within the same induction coil/matching network tooling configuration.

While the invention has been described with reference to the foregoing embodiments, various changes and modifications may be made thereto which fall within the scope of the appended claims.

What is claimed is:

1. An electrical connector, comprising:

a member;

heater element means comprising a ferromagnetic material on the member for heating the member to an autoregulated temperature, the ferromagnetic material having a Curie temperature at least equal to the autoregulated temperature and the ferromagnetic material being heated inductively to the Curie temperature when an alternating magnetic field is applied thereto;

a fusible material disposed on the member so as to be in heat conducting relationship therewith, the fusible material extending at least part way around the ferromagnetic material such that the fusible material forms a non-continuous electrically conducting path around the ferromagnetic material, the fusible material having a melting temperature no greater than the autoregulated temperature and the fusible material being melted when an alternating magnetic field is applied to the ferromagnetic material and the member is heated to the autoregulated temperature; and the member comprising an electrically conducting metal ferrule, the fusible material surrounding the ferrule and including opposed ends being separated form each other in a circumferential direction about the ferrule by a gap, the gap being wide enough to prevent surface voltages on the fusible material from arcing between the opposed ends when the ferromagnetic material is heated by electrical currents and eddy currents generated therein by an alternating magnetic field.

2. The connector of claim 1, wherein the gap extends in a direction substantially parallel to a central axis of the ferrule.

3. The connector of claim 1, wherein the member comprises a body of the ferromagnetic material and the heater element means comprises an outer layer of the body.

4. The connector of claim 1, wherein the member comprises a metal selected from the group consisting of copper and aliminum.

5. The connector of claim 1, wherein the ferromagnetic material comprises a Ni-Fe alloy.

6. An electrical connector, comprising:

a member;

heater element means comprising a ferromagnetic material on the member for heating the member to an autoregulated temperature, the ferromagnetic material having a Curie temperature at least equal to the autoregulated temperature and the ferromagnetic material being heated inductively to the Curie temperature when an alternating magnetic field is applied thereto; and a fusible material disposed on the member so as to be in heat conducting relationship therewith, the fusible material extending at least part way around the ferromagnetic material such that the fusible material forms a non-continuous electrically conducting path around the ferromagnetic material, the fusible material having a melting temperature no greater than the autoregulated temperature and the fusible material being melted when an alternating magnetic field is applied to the ferromagnetic material and the member is heated to the autoregulated temperature, the ember comprising an electrically conductive metal ferrule having a length in an axial direction parallel to a central axis of the ferrule, the ferromagnetic material comprising a coating on an outer periphery of the ferrule, a free end of a coaxial cable being attached to the connector, the coaxial cable including a central conductor and a tubular conductor insulated from the central conductor by a dielectric material, the tubular conductor having an outer periphery thereof facing an inner periphery of the ferrule.

7. The connector of claim 6, wherein the coating of ferromagnetic material extends completely around the ferrule and the ferromagnetic material has a length in the axial direction less than the length of the ferrule.

8. The connector of claim 6, wherein the coating of ferromagnetic material has a thickness less than about 1/20 of the thickness of the ferrule.

9. The connector of claim 6, wherein the connector includes a hollow metal body and a metal tightening nut, the body rotatably supporting the nut and the body being in electrical contact with the tubular conductor.

10. The connector of claim 9 wherein the sleeve surrounds at least part of the body, the fusible material and at least part of the ferrule.

11. The connector of claim 9, wherein the connector includes a hollow metal extension, the extension including at least one tapered surface and the body including at least one flange, the flange fitting around the tapered surface so as to clamp a front end of the extension to a rear end of the body.

12. The connector of claim 11, wherein an outer periphery of the extension faces an inner periphery of the tubular conductor.

13. The connector of claim 6, further comprising a dielectric coating on an outer periphery of at least one of the ferromagnetic material and the ferrule, the fusible material being disposed on an outer periphery of the dielectric coating.

14. The connector of claim 13, wherein the dielectric coating comprises polyimide.

15. The connector of claim 13, further comprising an electrically insulating heat-shrinkable sleeve surrounding the ferrule, the fusible material being between the outer periphery of the dielectric coating and an inner periphery of the sleeve.

16. The connector of claim 15, wherein a free end of a coaxial cable is attached to the connector, the coaxial cable including a central conductor and a tubular conductor insulated form the central conductor by a dielectric material, the tubular conductor having an outer periphery thereof facing an inner periphery of the ferrule.

17. The connector of claim 16, wherein the ferrule includes at least one port means therethrough for passage of the fusible material into contact with the tubular conductor so that the tubular conductor can be joined to the ferrule when the ferromagnetic material is heated to cause melting of the fusible material and shrinkage of the sleeve.

18. An electrical connector, comprising:

a member;

heater element means comprising a ferromagnetic material on the member for heating the member to an autoregulated temperature, the ferromagnetic material having a Curie temperature at least equal to the autoregulated temperature and the ferromagnetic material being heated inductively to the Curie temperature when an alternating magnetic field is applied thereto;

a fusible material disposed on the member so as to be in heat conducting relationship therewith, the fusible material extending at least part way around the ferromagnetic material such that the fusible material forms a non-continuous electrically conducting path around the ferromagnetic material, the fusible material having a melting temperature no greater than the autoregulated temperature and the fusible material being melted when an alternating magnetic field is applied to the ferromagnetic material and the member is heated to the autoregulated temperature, the member comprising an electrically conducting metal pin which is U-shaped in lateral cross-section, the fusible material being disposed on a concave surface of the pin and forming a non-continuous electrically conducting path around the pi, a sleeve of heat-recoverable electrically insulating material surrounding the pin, and the ferromagnetic material being disposed on a convex surface of the pin, the ferromagnetic material having a Curie temperature equal to a temperature no lower than the recovery temperature at which the sleeve shrinks when heat is applied thereto.

19. An electrical connector, comprising:

a member;

heater element means comprising a ferromagnetic material on the member for heating the member to an autoregulated temperature, the ferromagnetic material having a Curie temperature at least equal to the autoregulated temperature and the ferromagnetic material being heated inductively to the Curie temperature when an alternating magnetic field is applied thereto;

a fusible material disposed on the member so as to be in heat conducting relationship therewith, the fusible material extending at least part way around the ferromagnetic material such that the fusible material forms a non-continuous electrically conducting path around the ferromagnetic material, the fusible material having a melting temperature no greater than the autoregulated temperature and the fusible material being melted when an alternating magnetic field is applied to the ferromagnetic material and the member is heated to the autoregulated temperature;

the member comprising a central contact, the bore extending through one axial end of the central contact and in an axial direction along a central axis of the central contact and the fusible material filling part of the bore, the ferromagnetic material comprising a coating on an outer periphery of the central contact.

20. The connector of claim 19, wherein vent means comprising at least one radially extending hole extends between the bore and an outer periphery of the central contact.

21. The connector of claim 19, wherein a free end of a coaxial cable is attached to the connector, the coaxial cable including an inner central conductor and an outer tubular conductor insulated from the central conductor by a dielectric material, an end of the central conductor being located in the bore and the fusible material bonding the central conductor to the central contact.

22. The connector of claim 19, wherein the coating of ferromagnetic material extends completely around the central contact and the ferromagnetic material has a length in the axial direction at least equal to a length in the axial direction of the bore.

23. The connector of claim 22, further comprising a dielectric coating on an outer periphery of at least one of the ferromagnetic material and the central contact.

24. The connector of claim 22, wherein the coating of ferromagnetic material has a thickness in a radial direction less than about 1/20 of the thickness in the radial direction between an inner surface of the central contact defining the bore and the outer periphery of the central contact.

25. An electrical connector, comprising:

a first member;

first heater element means comprising a first ferromagnetic material on the first member for heating the first member to a first autoregulated temperature, the first ferromagnetic material having a Curie temperature at least equal to the first autoregulated temperature and the first ferromagnetic material being heated inductively to its Curie temperature when an alternating magnetic field is applied thereto;

a first fusible material disposed on the first member so as to be in heat conducting relationship therewith, the first fusible material extending at least part way around the first ferromagnetic material such that the first fusible material forms a non-continuous electrically conducting path around the first ferromagnetic material, the first fusible material being melted when an alternating magnetic field is applied to the first ferromagnetic material and the first member is heated to the first autoregulated temperature;

a second member;

second heater element means comprising a second ferromagnetic material on an outer periphery of the second member for heating the second member to a second autoregulated temperature, the second ferromagnetic material having a Curie temperature at least equal to the second autoregulated temperature and the second ferromagnetic material being heated inductively to its Curie temperature when an alternating magnetic field is applied thereto; and a second fusible material disposed in a bore in the second member so as to be in heat conducting relationship therewith, the second fusible material being melted when an alternating magnetic field is applied to the second ferromagnetic material and the second member is heated to the second autoregulated temperature.

26. The connector of claim 25, wherein the first member comprises an electrically conducting metal ferrule having a length in an axial direction parallel to a central axis of the ferrule, the first ferromagnetic material comprising a coating on an outer periphery of the ferrule.

27. The connector of claim 26, wherein the coating of ferromagnetic material extends completely around the ferrule and the coating of ferromagnetic material has a length in the axial direction less than the length of the ferrule.

28. The connector of claim 26, further comprising a dielectric coating on an outer periphery of at least one of the coating of ferromagnetic material and the ferrule, the first fusible material being disposed on an outer periphery of the dielectric coating.

29. The connector of claim 28, further comprising an electrically insulating heat-shrinkable sleeve surrounding the ferrule, the first fusible material being between the outer periphery of the dielectric coating and an inner periphery of the sleeve.

30. The connector of claim 29, wherein a free end of a coaxial cable is attached to the connector, the coaxial cable including an inner central conductor and an outer tubular conductor insulated from the central conductor by a dielectric material, the tubular conductor having an outer periphery thereof facing an inner periphery of the ferrule.

31. The connector of claim 29, wherein the ferrule includes at least one port means therethrough for passage of the first fusible material into contact with the tubular conductor so that the tubular conductor can be joined to the ferrule when the first ferromagnetic material is heated to cause melting of the first fusible material and shrinkage of the sleeve.

32. The connector of claim 26, wherein a free end of a coaxial cable is attached to the connector, the coaxial cable including an inner central conductor and an outer tubular conductor insulated from the central conductor by a dielectric material, the tubular conductor having an outer periphery thereof facing an inner periphery of the ferrule.

33. The connector of claim 32, wherein the connector includes a hollow metal body, a metal tightening nut and a hollow metal extension extending from a rear end of the body, the body rotatably supporting the nut and the body being in electrical contact with the tubular conductor, the extension having an outer periphery thereof facing an inner periphery of the tubular conductor.

34. The connector of claim 25, wherein the second member comprises a central contact, the bore extending in an axial direction into one axial end of the central contact and the second fusible material filling part of the bore.

35. The connector of claim 34, wherein a free end of a coaxial cable is attached to the connector, the coaxial cable including an inner central conductor and an outer tubular conductor insulated from the central conductor by a dielectric material, an end of the central conductor being located in the bore and the second fusible material bonding the central conductor to the central contact.

36. The connector of claim 34, wherein the second ferromagnetic material comprises a coating on an outer periphery of the central contact.

37. The connector of claim 36, wherein the coating of ferromagnetic material extends completely around the central contact and the coating of ferromagnetic material has a length in the axial direction at least equal to a length in the axial direction of the bore.

38. The connector of claim 37, further comprising a dielectric coating on an outer periphery of at least one of the coating of ferromagnetic material and the central contact.

* * * * *

UNITED STATES PATENT AND TRADEMARK OFFICE

CERTIFICATE OF CORRECTION

PATENT NO. : 5,167,545

DATED : December 1, 1992

INVENTOR(S) : Philip T. O'Brien et al.

It is certified that error appears in the above-identified patent and that said Letters Patent is hereby corrected as shown below:

Column 11, line 56, after "7" insert --.--
Column 12, line 48, after "operation" insert --.--
Column 12, line 49, after "heating" insert --.--
Column 12, line 56, after "polyimide" insert --.--

Signed and Sealed this

Eighth Day of February, 1994

Bruce Lehman

*Attest:*

BRUCE LEHMAN

*Attesting Officer*

*Commissioner of Patents and Trademarks*